US006773486B2

(12) United States Patent
Vayda

(10) Patent No.: US 6,773,486 B2
(45) Date of Patent: Aug. 10, 2004

(54) USE OF RICE HULL ASH IN STEELMAKING

(75) Inventor: Pierre Vayda, Burlington (CA)

(73) Assignee: Exothermic Distribution Corporation, Beamsville (CA)

( * ) Notice: Subject to any disclaimer, the term of this patent is extended or adjusted under 35 U.S.C. 154(b) by 0 days.

(21) Appl. No.: 10/227,807

(22) Filed: Aug. 27, 2002

(65) Prior Publication Data

US 2003/0051582 A1 Mar. 20, 2003

Related U.S. Application Data

(60) Provisional application No. 60/315,023, filed on Aug. 28, 2001.

(51) Int. Cl.[7] ..... C22B 9/00

(52) U.S. Cl. ..... 75/709; 75/751; 75/764; 75/773

(58) Field of Search ..... 75/709, 751, 764, 75/773

(56) References Cited

U.S. PATENT DOCUMENTS

| | | | | |
|---|---|---|---|---|
| 4,440,575 A | | 4/1984 | Daussan et al. | 106/38 |
| 4,555,448 A | | 11/1985 | Durham | 428/402 |
| 5,073,281 A | | 12/1991 | Paules et al. | 252/62 |
| 5,360,633 A | | 11/1994 | Dean | 427/220 |
| 5,431,825 A | * | 7/1995 | Diel | 210/719 |
| 5,916,827 A | * | 6/1999 | Vayda | 44/580 |
| 6,342,088 B1 | | 1/2002 | Klatt et al. | 75/300 |
| 6,346,146 B1 | | 2/2002 | Duselis et al. | 106/713 |
| 6,409,817 B1 | | 6/2002 | Stephens | 106/601 |

FOREIGN PATENT DOCUMENTS

JP 8-67906 * 3/1996

* cited by examiner

*Primary Examiner*—Melvyn Andrews
(74) *Attorney, Agent, or Firm*—Shoemaker and Mattare

(57) ABSTRACT

A method is provided by which rice hull ash is pelletized for use in steelmaking. The rice hull ash is blended with lime or dolime, and also with a mixture of water and molasses. This generates heat as the lime and water react to form lime hydroxide, a known binder. The heat thus generated reduces the energy required for drying the pellets.

9 Claims, 4 Drawing Sheets

USE OF RICE HULL ASH IN STEELMAKING

This application claims the benefit of U.S. Provisional Application Ser. No. 60/315,023, filed Aug. 28, 2001.

This invention relates to the steelmaking industry, and has to do particularly with the use of rice hull ash for certain purposes relating to steelmaking.

BACKGROUND OF THIS INVENTION

Rice hull ash, a by-product of the combustion of rice hull, is used in the steel industry to insulate liquid steel (temperature of liquid steel: 1560° C.).

| | | |
|---|---|---|
| Rice hull ash is composed of: | amorphous silica | 85–95% |
| | Crystalline silica | 5–10% |
| | Carbon | 0–10% |

Crystalline silica is a known health hazard.

Rice hull ash comes in a fine powder form, and a substantial portion thereof is respirable particles (<10 micron).

Typically, rice hull ash is used at temperatures exceeding 1500° C., well above the temperature (1350° C.) at which the amorphous silica changes into crystalline silica, mainly in the form of quartz and/or cristobolite Pelletizing the powdered rice hull ash will alleviate the problem of respirable crystalline silica, but not the fact that crystalline silica has been created. In addition, the type of binder used to hold the dust in the pellet form, such as molasses, will generally decompose at steelmaking temperatures, or if sodium silicate is used it will flux the ash at a temperature of approximately 1150–1200° C. and therefore will create a molten mash with no insulating properties.

GENERAL DESCRIPTION OF THE INVENTION

An object of one aspect of this invention is to change the nature of the hazardous silica (crystalline form) by creating compounds like calcium silicate or calcium magnesium silicate, neither of which is hazardous at room temperature or steelmaking temperatures.

An object of another aspect of this invention relates to the pelletizing or granulating of the rice hull ash. By the process of pelletizing or granulating, there is no change in the porosity which is natural to rice hull ash, allowing the material to retain its insulating properties as well as its floatability.

More particularly, this invention proves a method of using rice hull ash in steelmaking, comprising the steps of:

blending the rice hull ash with one or more of i) lime, or ii) dolime, and with a mixture of water and molasses, thus generating heat as the lime and water react to form lime hydroxide, which is a known binder, and pelletizing the resulting blend, such that the heat generated by the lime/water reaction reduces the energy required for drying the pellets.

GENERAL DESCRIPTION OF THE DRAWINGS

The accompanying drawings contain FIGS. 1 to 4, which are X-ray diffraction graphs showing the change in chemistry and in morphology of the rice hull ash pellets, when these are burned at about 1250° C.

DETAILED DESCRIPTION OF THE INVENTION

I have found that the use of lime (or dolime) in combination with molasses to form a binder, has several positive effects:

By blending the ash and lime first, and then adding water and molasses (liquids), the pellets/granules will form as usual but in addition steam will be generated as the lime and water react to form lime hydroxide, a good binder. Also, the heat generated will reduce the energy required for drying the pellets/granules.

After the pellets/granules have been used in a steel plant at 1500° C. or more for several hours, a) the pellets do not break down at steelmaking temperatures. Hence, no dust is created, even when the tundish is dumped after a casting series (8 to 12 hours);

b) lime and magnesia combine with silica, creating diopside, a calcium-magnesium-silicate, as well as di-calcium-silicate, tri-calcium-silicate or any similar combination. None of these materials is considered a health hazard;

c) the crystal size increases as well. The larger the crystal, the more stable it is.

Additional organic binders such as rice flour will help to form the pellets earlier and with less water. First, a dry blend of rice ash, lime, and organic binder is produced, to which blend is then added molasses, diluted with water. By wetting the blend with water, pellets will form because the organic binder or lime reacting with water will entrap the rice ash into a pellet.

Turning now to the graphs of FIGS. 1–4, a brief description is in order.

Figure 1:
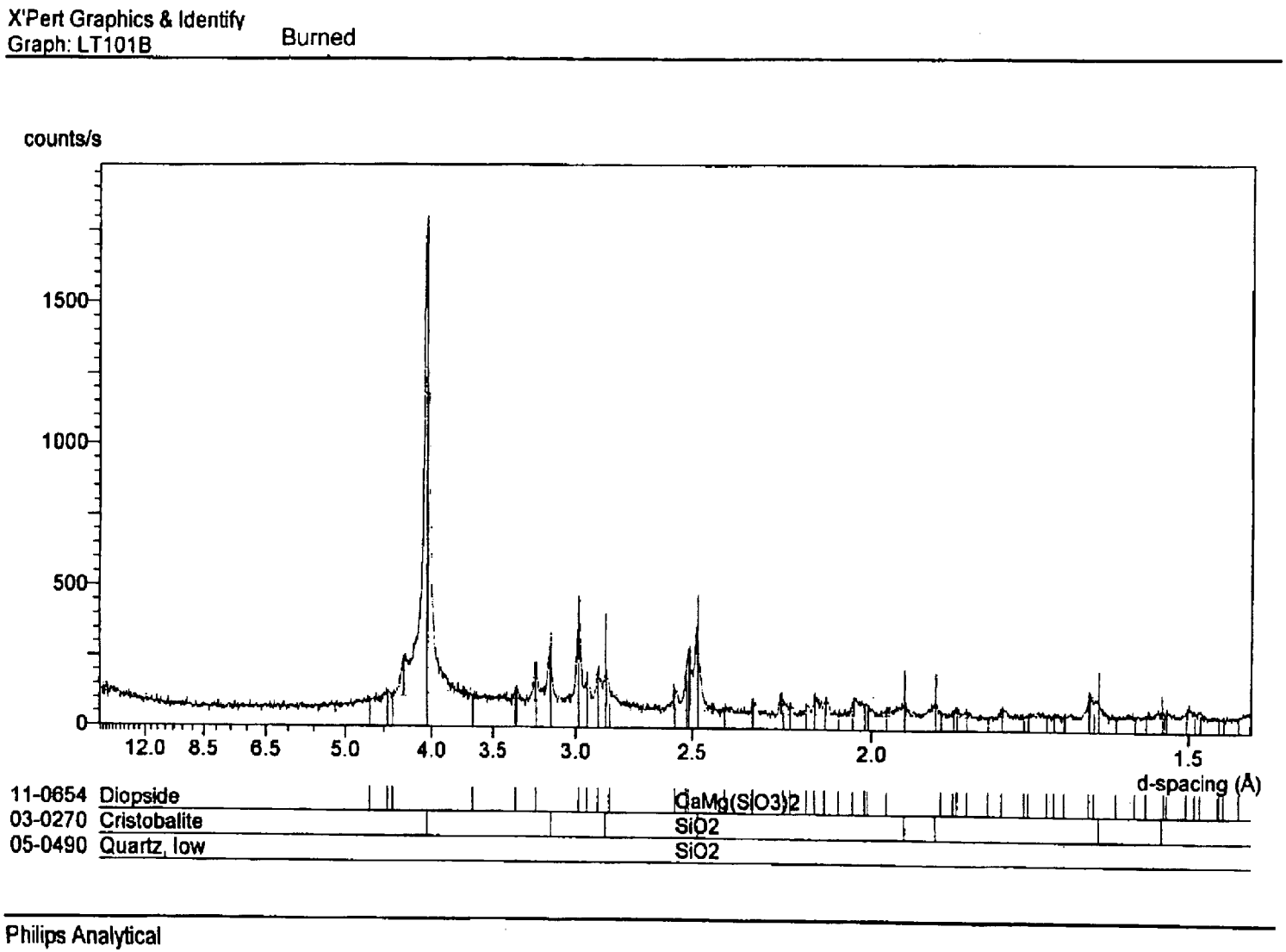
FIG. 1 is an X-ray spectrograph, showing the composition after the pellet has been burned. Notice the presence of diopside, which is a calcium-magnesium silicate
Figure 2:
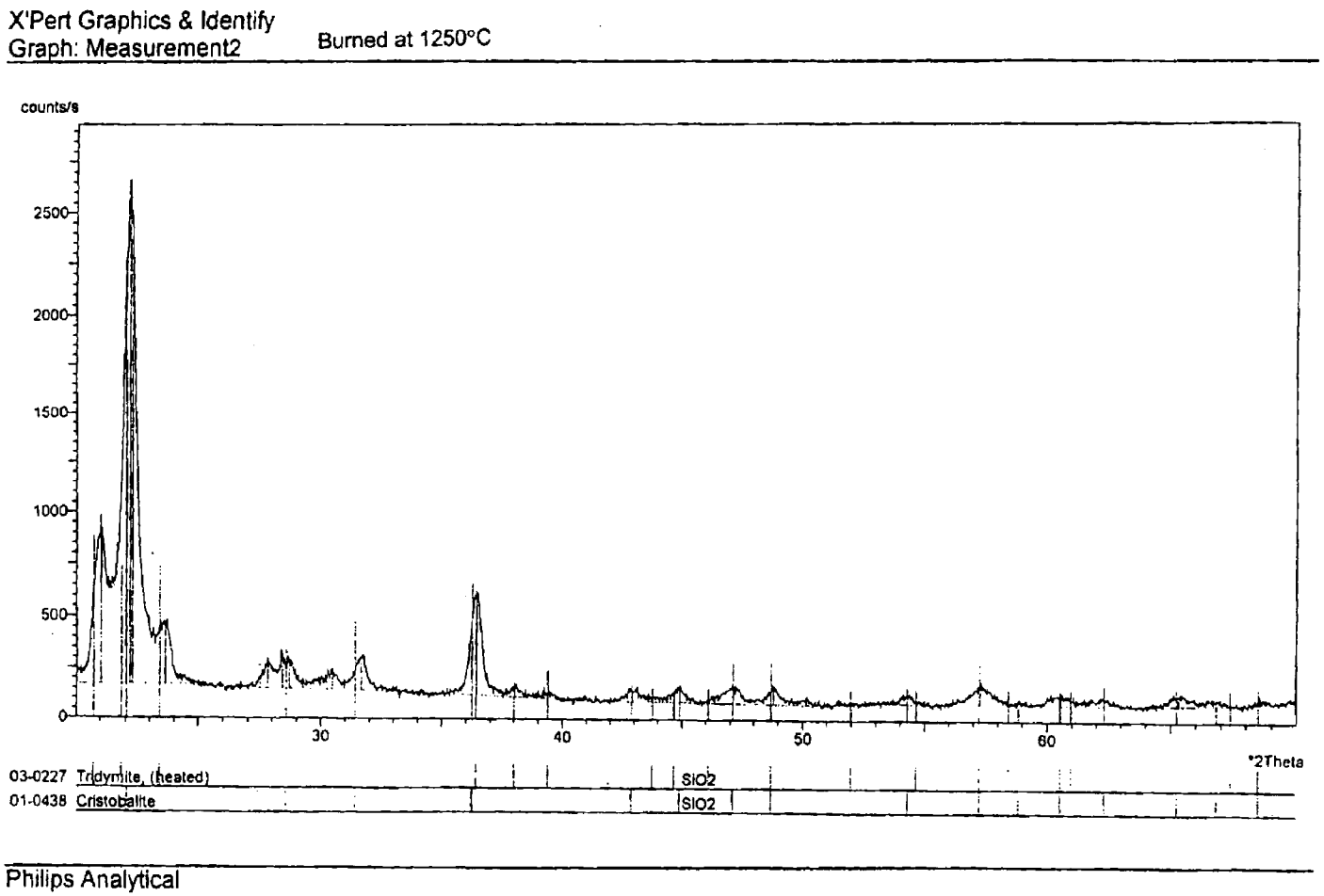
Figure 3:
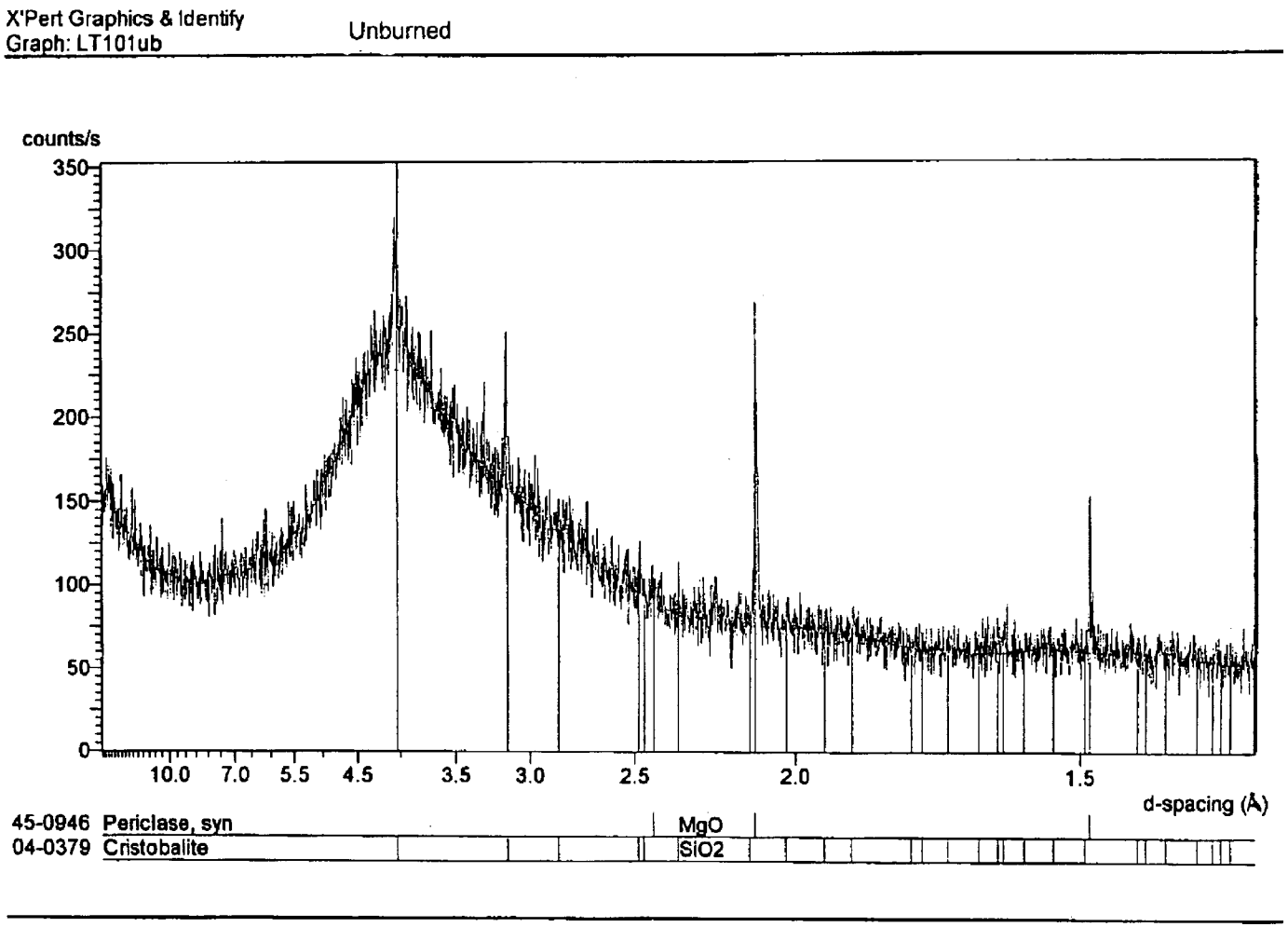
FIG. 3 is an X-ray diffraction graph of the rice hull pellets in the unburned condition. The major peaks or "spikes" identify the crystalline morphological form known as "crystobolite", while a further set of spikes or peaks identifies penclase, a magnesium compound.
Figure 4:
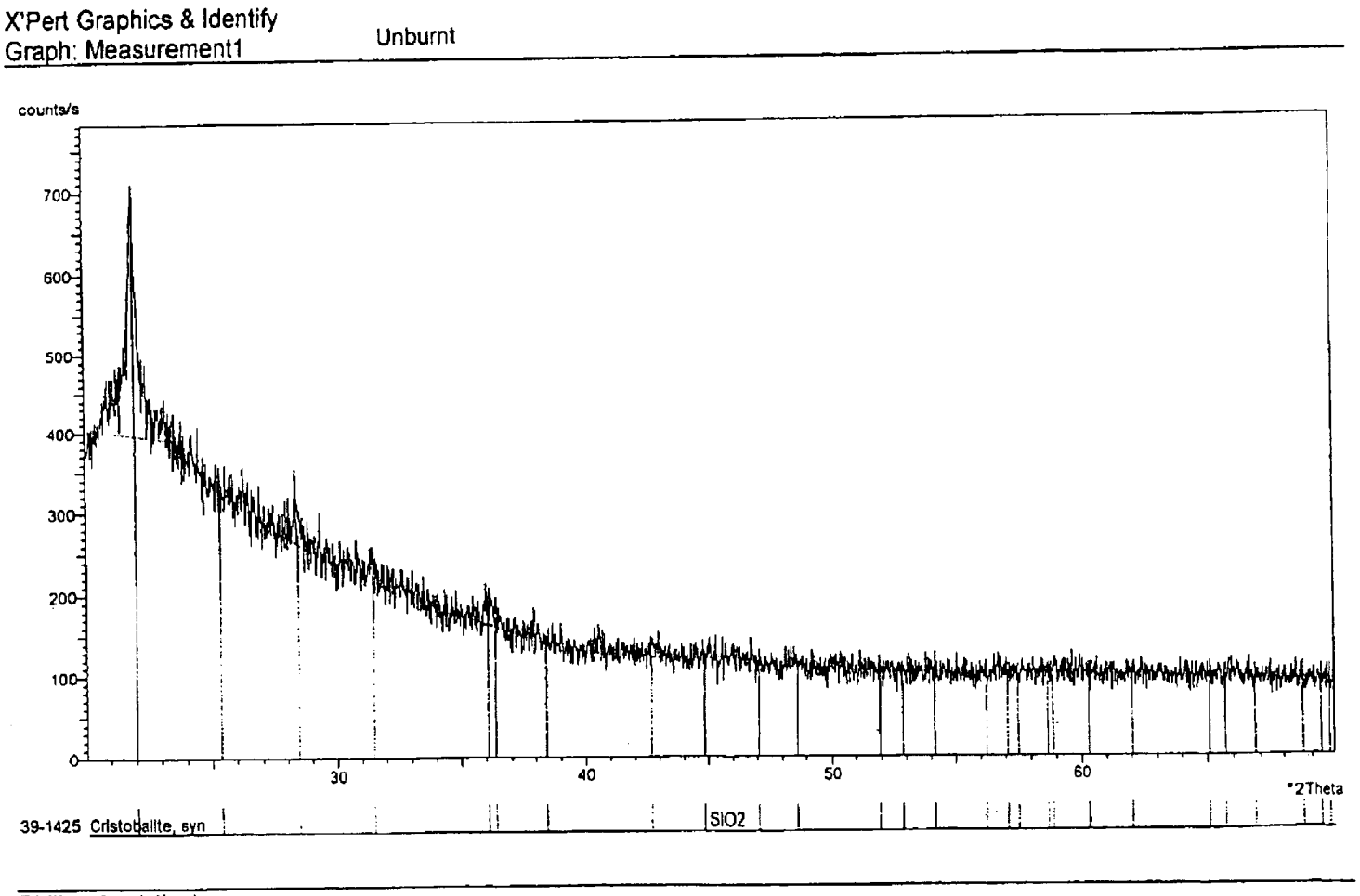
FIG. 4 is an X-ray diffraction graph identifying crystobolite in the unburnt pellet.

FIG. 2, showing the X-ray diffraction graph after the pellet has been burnt at 1250° C. for over 15 hours (duplicating the actual use in a steel plant).

It is to be noted that the pelletizing or granulation of the rice hull ash does not change the porosity of the rice hull ash, and thus this material retains its insulating and floatation properties.

Test Report

A test of the above-described method was initiated by delivering rice hull ash material to a screw conveyor at a feed rate of 600 pounds per hour through a 3" volumetric feeder. The rice hull ash was combined with 15% burnt lime in the screw conveyor, via a 2" volumetric feeder. The mixture was delivered to a pin mixer at a total feed rate of 690 pounds per hour.

The binder solution utilized for testing was a mixture of 50% agricultural molasses and 50% water.

Various combinations of spray nozzles and rotor speeds were tried, but none could produce a satisfactory product. When pellets were produced in the pin mixer, they were considered too wet.

On the first pass through the pin mixer the discharging material moisture content was 22.7%. This material was transferred to the DP-14 disc pelletizer by hand, where more moisture had to be added to form pellets. The pellets produced with this procedure were also considered too wet. Trouble was also encountered due to material build-up on the back of the pan, which constantly fell off, producing large lumps of material, that discharged along with the pellets. This appears to be caused by the reaction of the burnt lime, drying the build-up and allowing it to fall off.

The remainder of the 22.7% moisture material was reintroduced to the pin mixer again. When additional liquid binder was added in small amounts, the material would become too wet and stop discharging. During this occurrence, the binder addition had to be halted until the maternal started to discharge. Several attempts were made at this procedure, but no satisfactory pellets were produced with this method.

A combination of the used materials was again passed through the pin mixer, this time adding approximately another 14% of burnt lime. The total burnt lime addition was approximately 29 to 30%. With this combination of rice hull ash and burnt lime, and by adding slightly more liquid binder to the pin mixer, it was possible to produce satisfactory pellets. The green moisture content of the pellet produced in this form was 23.4% (by weight).

The final equipment settings producing the pellet sample are given below.

Equipment and Specifications

| Test 1 | |
|---|---|
| Materials | 70% rice hull ash. & 30% burnt lime |
| Binder | 50% agricultural molasses & 50% water |
| Pelletizer | pin mixer |
| Targeted product size | +1/64" |

Raw Material Analysis for Rice Hull Ash

Moisture Content: 1.9%

Density: Aerated 17.5 PCF D-aerated 25.3 PCF

Raw Sieve Analysis:

| Mesh US Std. | Opening in inches | Percent Retained | Accumulated % Retained |
|---|---|---|---|
| 10 | 0.0787 | 0.0% | 0.0% |
| 45 | 0.0139 | 3.4% | 3.4% |
| 80 | 0.0070 | 17.6% | 21.0% |
| 120 | 0.0049 | 19.5% | 40.5% |
| 200 | 0.0029 | 22.3% | 62.8% |
| 325 | 0.0017 | 18.5% | 81.3% |
| Pan | 0.0000 | 18.7% | 100.0% |

Equipment

| | | | |
|---|---|---|---|
| Pelletizer Type | Pin Mixer | Model# | 12D54L |
| Drive Motor (hp) | 40@ 230 Volts | Liner | |
| Speed (RPM) | 650 | Spray Nozzle# | #4003 |
| Pin/Paddle Clearance | 3/16" | Quantity | 1 |
| Amp Draw | 50 | Spray Location | 1st Port (inlet side) |
| Spray Rate (GPM) | N/A | Feed rate (lbs/hr) | 440 |
| Spray Pressure (psi) | 7 | Feeder Used | Both 2" & 3" Volumetric |

Pellet Analysis for 70% Rice Hull Ash, & 30% Burnt Lime

| | 24 Hours Air Dried Pellets | 48 Hours Air Dried Pellets | Oven Dried Pellets |
|---|---|---|---|
| Moisture Content (%) | 20.3% | 21.1% | 1.5% |
| Bulk Density (PCF) | 51.5 PCF | 50.9 PCF | 45.7 PCT |
| 18" Drop Test (Avg) | 50 + avg | 50 + avg | 50 + avg |
| 72" Drop Test (Avg) | N/A | N/A | N/A |
| Compression Test (lbs) | 1.2 lbs | 1.0 lbs | 5.5 lbs |
| Attrition Test (% loss) | 1.5% | 1.3% | 2.1% |

Pellet Size Tested Moisture content and bulk density were tested using "as discharged" pellets. 6×8 mesh pellets were used for the drop and crush tests. 6×8×20 mesh pellets were used for the attrition test.

The green pellet moisture content was 23.4%

Pellet Sieve Analysis

| Pellet Sieve Analysis | | | |
|---|---|---|---|
| Mesh US Std. | Opening in inches | Percent Retained | Accumulated % Retained |
| 6 | 0.1320 | 4.7% | 4.7% |
| 8 | 0.0937 | 9.2% | 13.9% |
| 12 | 0.0661 | 12.3% | 26.2% |
| 20 | 0.0331 | 34.4% | 60.6% |
| 30 | 0.0234 | 13.8% | 74.4% |
| 45 | 0.0139 | 14.8% | 89.2% |
| 80 | 0.0070 | 6.8% | 96.0% |
| Pan | 0.0000 | 4.0% | 100.0% |

While several embodiments of the invention have been described above and illustrated in the attached graphs, it will be evident to those skilled in the art that modifications may be made to the invention, without departing from its essence.

What is claimed is:

1. A method of chemically modifying hazardous crystalline structure of rice hull ash comprising crystalline silica into a non-hazardous compound for application in steelmaking, comprising:

blending the rice hull ash comprising crystalline silica with at least one of lime and dolime, and water and molasses to form a blend; and reacting the blend at a temperature sufficient to form a non-hazardous compound of at least one of diopside, calcium-magnesium-silicate, calcium-silicate, di-calcium silicate, and tri-calcium silicate.

2. The method of claim 1, wherein said blending comprises pelletizing/granulating to produce pellets/granules.

3. The method of claim 2, wherein said blending comprises adding the water and molasses during pelletizing/granulating.

4. The method of claim 3, wherein said blending further comprises reacting the water, molasses, and the at least one of lime and dolime, thereby generating heat that dries the blend as it exits the pelletizer/granulator, to produce dried pellets or granules.

5. The method of claim 2, wherein said reacting the blend comprises spreading the pellets or granules onto liquid steel to cause formation of the non-hazardous compound.

6. The method of claim 2, wherein reacting the blend comprises reacting at a temperature of about 1250° C. or greater.

7. The method of claim 1, wherein reacting the blend comprises reacting the blend at a temperature of the liquid steel.

8. The method of claim 1, wherein reacting the blend comprises reacting the blend at a temperature of at least 1500° C.

9. The method of claim 1, wherein said blending the rice hull ash comprises blending rice flour with the rice hull ash, the at least one of lime and dolime, and the water and molasses.

* * * * *